United States Patent [19]

Fincham

[11] Patent Number: 4,467,712

[45] Date of Patent: Aug. 28, 1984

[54] WOOD BALER

[76] Inventor: James R. Fincham, Rte. 3, Box 75B, Leon, Iowa 50144

[21] Appl. No.: 383,997

[22] Filed: Jun. 1, 1982

[51] Int. Cl.[3] ..... B65B 13/20

[52] U.S. Cl. ..... 100/8; 100/3; 100/98 R; 100/100; 100/246; 100/295; 144/3 K

[58] Field of Search ..... 100/3, 8, 94, 98 R, 100/242, 246, 247, 248, 214, 255, 295, 100; 144/193 R, 193 K, 3 K

[56] References Cited

U.S. PATENT DOCUMENTS

| | | | |
|---|---|---|---|
| 397,457 | 2/1889 | Crain | 100/3 X |
| 716,422 | 12/1902 | Hulscher | 100/246 X |
| 2,000,382 | 5/1935 | Evans | 100/247 X |
| 2,933,866 | 4/1960 | Cranston . | |
| 2,956,498 | 10/1960 | Durrenberger . | |
| 3,099,203 | 7/1963 | Klemm | 100/98 R X |
| 3,427,959 | 2/1969 | Keil . | |
| 3,939,762 | 2/1976 | Smitherman . | |
| 3,996,849 | 12/1976 | Del Jiacco . | |
| 4,103,724 | 8/1978 | Braid . | |
| 4,184,426 | 1/1980 | Oosterling | 100/100 |
| 4,219,057 | 8/1980 | Falk | 144/3 K |
| 4,240,476 | 12/1980 | Rattray . | |
| 4,252,165 | 2/1981 | Hansen . | |
| 4,273,171 | 6/1981 | Spaulding . | |
| 4,293,013 | 10/1981 | Phelps . | |

*Primary Examiner*—Billy J. Wilhite

*Attorney, Agent, or Firm*—Zarley, McKee, Thomte, Voorhees & Sease

[57] ABSTRACT

The wood baler of the present invention comprises a rectangular frame adapted to receive a plurality of split pieces of wood. A pressure member is movably mounted to the frame so as to move toward and away from one of the end frame members. Hydraulic cylinders are connected to the pressure member for causing it to move toward the opposite frame member, thereby compressing the wood so that it can be bound together in a bale. One of the upper or lower frame members is movable from a first position to a second position which increases the distance between the upper and lower frame members. This permits release of the bale after it has been secured together.

10 Claims, 6 Drawing Figures

WOOD BALER

BACKGROUND OF THE INVENTION

This invention relates to a wood baling device.

The packaging of firewood is difficult due to the cumbersome weight and size of the various pieces of firewood. One means for packaging firewood is to compress a plurality of pieces of wood together and to bind them together in the compressed state so that they can be sold in a bale or unit. However, the compressing and securing of such a bale is a difficult and cumbersome thing to do.

Hydraulic means have been provided for compressing the wood so that it can be bound together. An example of such a device is shown in U.S. Pat. No. 3,939,762 dated Feb. 24, 1976. However, the disadvantage of these devices is that it is difficult to release the wood from the device after the compression and binding has been completed. The compression of the wood causes the wood to be frictionally engaged within the device and mere release of the hydraulic pressure member does not release the wood from the device.

For commercial purposes, it is desirable to be able to compress and bind the wood quickly so that large quantities of bales can be secured together. It is also desirable that the bales be in a position after binding which permits them to be lifted by a forklift or other conveyance device.

Therefore, a primary object of the present invention is the provision of an improved wood baling device.

A further object of the present invention is the provision of a wood baling device wherein the wood can be easily removed from the device after it has been compressed and bound together.

A further object of the present invention is the provision of a wood baling device which permits the bale of wood to be removed by a forklift or other mechanical device.

A further object of the present invention is the provision of a wood baling device which can also be used as a wood splitting device.

A further object of the present invention is the provision of a wood baling device which is mobile and can be transported to a convenient location.

A further object of the present invention is the provision of a device which is economical to manufacture, durable in use and efficient in operation.

SUMMARY OF THE INVENTION

The present invention utilizes a rectangular frame having top and bottom members and opposite end members. A pressure member extends between the top and bottom frame members and is slidably mounted for longitudinal movement along the top and bottom members. A pair of hydraulic cylinders connected to the pressure member force the pressure member toward one end of the rectangle so as to create compression of the wood between the pressure member and the opposite end of the rectangle.

The top frame member of the rectangular frame is movable from a first position to a second position which expands the distance between the top and bottom frame members. This permits the release of the wood bale after the bale has been compressed and bound together. While the top frame member is preferably movable, the device would also work satisfactorily if the bottom frame member were movable instead.

The rectangular frame is mounted on wheels and can be transported to any desired location. Mounted to the top of the frame member are a pair of strap reels having strapping mounted thereon. The strapping may be unwound from the reels and wrapped around the wool bale quickly and easily so as to permit the bale to be bound together once it is compressed.

A wedge member is provided which can be detachably secured to the bottom frame member in a plurality of preselected positions. The wedge member may be attached to the bottom frame members with its sharp edge presented toward the pressure member. In this position, the device may operate as a wood splitting device with the log being placed between the pressure member and the wedge member. Actuation of the hydraulic cylinders causes the pressure member to force the log against the wedge member, thereby splitting it.

DETAILED DESCRIPTION OF THE PREFERRED EMBODIMENT

Figure 1:
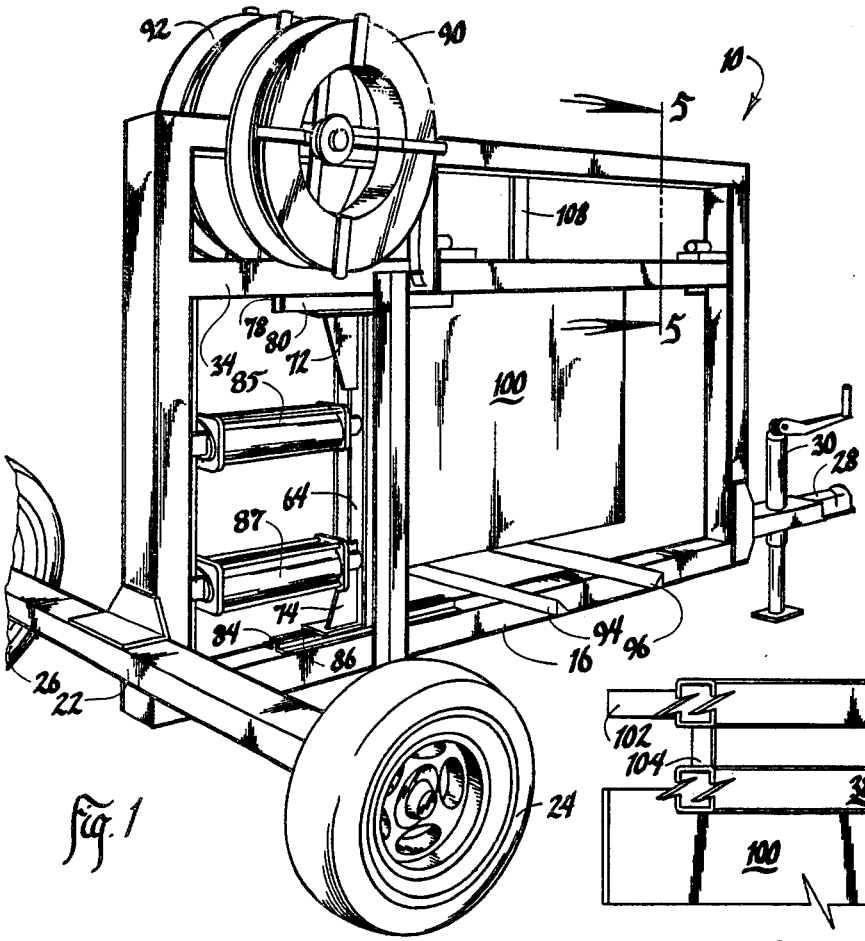
FIG. 1 is a perspective view of the present invention.

Referring to the drawings, the numeral 10 generally designates the baling device of the present invention. Device 10 comprises an outer support frame 12, comprising an upper support frame member 14, a lower support frame member 16 and two opposite end frame members 18 and 20. An axle frame 22 is secured across one end of support frame 12 and includes a pair of wheels 24, 26 thereon. A tongue 28 extends from the opposite end of frame member 12, and includes a jack 30 thereon.

Extending horizontally across support frame 12 is an interior top frame member 32 which is comprised of a fixed piece 34, and a movable piece 36. Together fixed piece 34 and movable piece 36 form the top frame member 32 of a rectangular frame which is comprised of top frame member 32, end frame members 18, 20 and bottom frame member 16.

Figure 5:
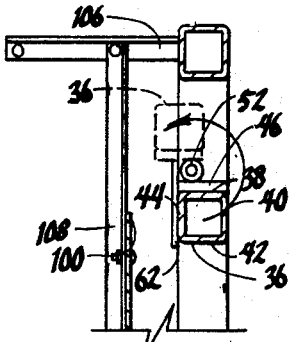
FIG. 5 is a sectional view taken along line 5—5 of FIG. 1.

Movable frame member 36 is approximately square in cross-section and as viewed in FIG. 5 includes four outer surfaces 38, 40, 42 and 44. Mounted on surface 38 are a pair of hinge support blocks 46, 48 to which are welded or otherwise fixedly secured, a pair of hinge pins 50, 52. Hinge pin 50 is inserted in a pin receiving hole 54 which extends through a short vertical strut 58. Hinge pin 52 extends through a pin receiving hole 56 in vertical end frame member 20. Hinge pin 52 has a lever arm 60 extending at right angles thereto on the outside of frame 12. Rotation of lever arm 60 causes movable piece 36 to rotate about the horizontal axis formed by pins 50, 52.

Referring to FIG. 5, it can be seen that the pivotal axis provided by hinge pin 52 is located off center from the geometric cross-sectional center of movable piece 36. Furthermore, the hinge pin 52 is located to the left of the vertical cross-sectional centerline of movable piece 36. A stop plate 62 is fixed to vertical end frame member 20 and is positioned so as to engage surface 44 of movable piece 36 as shown in FIG. 5. In this position, surface 42 is presented towards the wood bundle. When it is desired to release the pressure on the wood bundle, handle 60 is rotated in a clockwise direction as viewed in FIG. 4 (this would be a counterclockwise direction as viewed in FIG. 5). Member 36 rotates about axis 52 from the position shown in solid lines in FIG. 5 to the position shown in shadow lines in FIG. 5. In this upper pressure release position, surface 36 is presented upwardly in contrast to its downward position as shown in solid lines in FIG. 5. Placement of axis 52 adjacent the plane defined by surface 44 permits the member 36 to rotate easily from its lower position shown in solid lines to its upper position shown in shadow lines.

An elongated pressure member 64 includes a vertical portion 66, an upper track follower 68 and a lower track follower 70. Track followers 68, 70 are formed by angle members which have two adjacent legs joined together in unitary construction. An upper gusset and a lower gusset 72, 74 provide reinforcement of the angle members to the vertical portion 66. Track member 68 is slidably inserted within a U-shaped channel or track 76 formed by two spaced apart angle members 78, 80 which are welded to the undersurface of fixed piece 34. Similarly, bottom track follower 70 is slidably inserted in a track 82 formed by two spaced apart angle members 84, 86 welded to the upper surface of bottom frame member 16.

Figure 2:
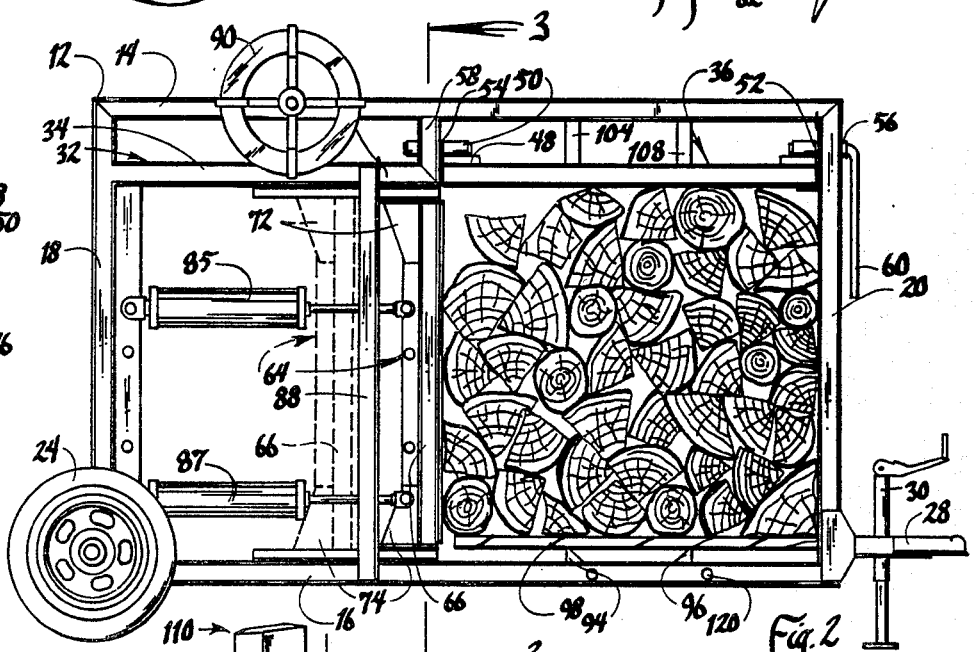
FIG. 2 is a front elevational view of the present invention.

The arrangement of track followers 68, 70 in tracks 76, 82 permits pressure member 64 to slide from a first position shown in shadow lines in FIG. 2 to an extended position shown in solid lines in FIG. 2. Movement between these two positions is provided by a pair of hydraulic cylinders 85, 87 which are interconnected between end frame member 18 and pressure member 64.

A vertical angle member 88 extends between fixed piece 34 and bottom frame member 16 so as to restrict flexing and misalignment of members 34 and 16 when pressure member 64 is actuated. The rectangular area for the wood logs is defined primarily by movable member 36, pressure member 64, bottom frame member 16 and end frame member 20.

A pair of strap reels 90, 92 are mounted on the upper surface of outer support frame 12 and are rotatably secured thereto so as to permit strapping to be unrolled therefrom. Strapping is used to bind the wood after it has been compressed into a bundle or bale.

A pair of cross angle members 94, 96 are secured transversely to bottom frame member 16. These cross frame members are used to support a support board or pallet 98 in spaced relation above bottom frame member 16. This space permits a forklift or other mechanical transporting device to be inserted underneath the wood bundle after it has been secured so that the bundle can be transported mechanically.

A backboard 100 is secured to the rearward ends of angles 94, 96 by means (not shown) and extends upwardly therefrom. A support structure provided by angle members 102, 104, 106, 108 is attached to the upper end of backboard 100. Backboard 100 provides a surface against which the ends of the wood may be stacked so that they will lie in approximately the same vertical plane.

Figure 3:
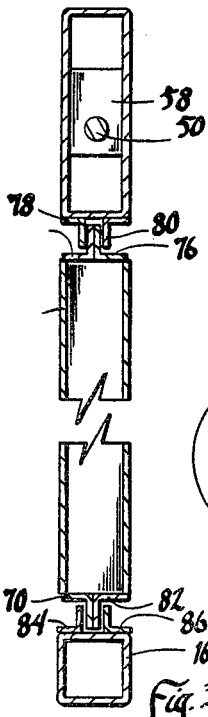
FIG. 3 is a sectional view taken along line 3—3 of FIG. 2.

In operation, the wood is stacked on support board 98 with the ends of the wood fitted against backboard 100. During the insertion of the wood into the device, cylinders 85, 87 are withdrawn so as to place pressure member 64 in its retracted position. Movable piece 36 is positioned in its lowermost position such as shown in FIG. 5 and in FIG. 2. After the wood has been inserted into the rectangular area between members 36, 64, 16 and 20, hydraulic cylinders 84, 86 are actuated to cause pressure member 64 to move from its retracted position to its extended position shown in solid lines in FIG. 2. This causes the wood to be compressed together and compacted as shown in FIG. 3. While in this compacted state, strapping is unrolled from reels 92, 90 and is secured around the outer periphery of the bundle of wood. After the wood has been secured together, cylinders 85, 87 are actuated to withdraw pressure member 64 to its original retracted position shown in shadow lines in FIG. 2. In this position, the wood bundle is still frictionally held within the device by virtue of the vertical pressure the wood exerts on members 36 and 16.

Figure 4:
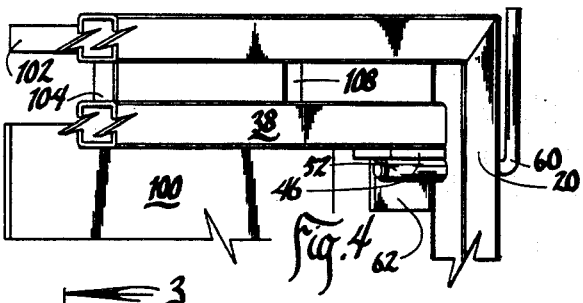
FIG. 4 is a partial perspective view of the movable upper frame member of the device.

In order to relieve this vertical pressure, handle 60 is rotated in a clockwise direction as viewed in FIG. 4, so as to cause member 36 to rotate from the position shown in solid lines in FIG. 5 to the position shown in shadow lines in FIG. 5. This relieves the pressure from the bundle of wood because it moves surface 36 upwardly away from the bundle of wood. The offset relationship of the axis 52 of member 36 minimizes the binding of member 36 as it is rotated from its lowermost to its uppermost position.

With both member 36 and pressure member 64 withdrawn, the bundle of wood is free for removal from the device. A forklift or other device may be utilized to remove the wood bundle.

Figure 6:
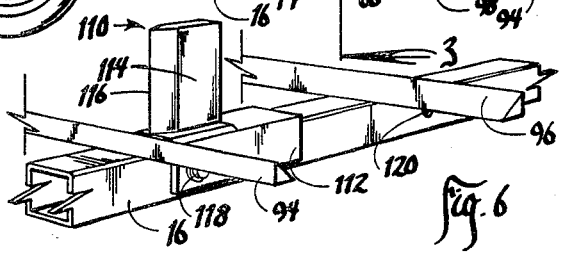
FIG. 6 is a detailed perspective view of a wedge member which can be used with applicant's invention for the purpose of splitting wood.

The present invention also has the capability of operating as a wood splitting device. A wedge member 110 is shown in FIG. 6 and includes a U-shaped channel 112 adapted to slidably fit over bottom frame member 16. Secured to the top of U-shaped channel 112 is a wedge blade 114 having a cutting edge 116. The side flanges of U-shaped member 112 are provided with holes for receiving a pin 118. Similarly, member 16 is provided with a plurality of holes 120 for receiving pin 118. Wedge member 110 is placed in the position shown in FIG. 6 with the holes in channel 112 in registered alignment with one of holes 120 in member 16. Pin 118 is inserted and the device 110 is held in fixed engagement to member 16. Cutting edge 116 is placed in facing relation to pressure member 64 so that a log can be placed therebetween for splitting. Device 110 can be easily removed merely by pulling pin 118 and lifting member 110 off of bottom member 16.

The device of the present invention permits quick bundling and securing of bales of split wood. It has been found that the present device speeds up the bundling process to the extent that nearly ten times as much wood can be bundled in a given time period than would be the case with manual bundling. The device is simple in construction and efficient in operation.

Thus, it can be seen that the device accomplishes at least all of its stated objectives.

What is claimed is:

1. A wood baling device comprising:

an elongated rectangular frame having a top frame member, a bottom frame member, and first and second opposite end frame members, said top frame member comprising a fixed part and a movable part;

an elongated vertically disposed pressure member having upper and lower ends;

bearing means movably connecting said upper end of said pressure member to said fixed part of said top frame member and movably connecting said lower end of said pressure member to said bottom frame member for longitudinal movement of said pressure member with respect to said fixed part of said top frame member and said bottom frame member; whereby said pressure member is movable from a first position located a first distance from said second end frame member to a second position located a second distance from said second end frame member, said second distance being less than said first distance;

extensible power means between said first end member and said pressure member for moving said pressure member between said first and second positions;

said movable part of said top frame member being movable from an initial position to a pressure release position, the distance between said top and bottom frame members being increased as said top frame member moves to said pressure release position.

2. A wood baling device according to claim 1 wherein said bearing means comprises elongated track means on said top and bottom frame members, and track follower means on said upper and lower ends of said pressure member, said track follower means being fitted within said track means for longitudinal sliding movement therein.

3. A wood baling device according to claim 1 and further comprising a pair of strap reels rotatably mounted to said rectangular frame on opposite sides thereof, said reels being rotatable about a horizontal axis.

4. A wood baling device according to claim 1 wherein said movable part of said top frame member comprises in cross section first and second surfaces, said first surface being presented toward said bottom frame member when said movable part of said top frame member is in said initial position and said second surface being presented toward said bottom member when said movable part of said top frame member is in said release position.

5. A wood baling device according to claim 4 wherein said movable part of said top frame member is pivotally mounted to said end frame members for pivotal movement about a horizontal axis.

6. A wood baling device according to claim 5 wherein said horizontal pivotal axis of said movable part of said top frame member is eccentrically offset from the geometric cross-sectional center of said movable part of said top frame member.

7. A wood baling device according to claim 6 and further comprising a lever arm connected to and extending radially outwardly from the pivotal axis of said movable part of said top frame member for permitting manual rotation of said movable part of said top frame member from said initial to said release position.

8. A wood baling device according to claim 7 wherein stop means are fixed to said rectangular frame for engaging said movable part of said top frame member and limiting movement of said movable part of said top frame member between said initial and release positions.

9. A wood baling device according to claim 1 and further comprising a wedge member having a sharp edge, wedge securing means for detachably securing said wedge member to said bottom frame member with said sharp edge of said wedge member being presented toward said pressure member.

10. A wood baling device according to claim 9 wherein said securing means comprise a plurality of spaced apart holes along the length of said bottom frame and a pin adapted to be selectively inserted into one of said holes, said wedge member having a pair of flanges spaced apart so as to embrace said bottom frame member therebetween, said flanges being provided with holes which are positioned so as to register with any one of said holes in said bottom frame member for receiving said pin so as to detachably secure said wedge member to said bottom frame member.

* * * * *